US005460003A

United States Patent [19]

Nenov

[11] Patent Number: 5,460,003

[45] Date of Patent: Oct. 24, 1995

[54] EXPANSION TURBINE FOR CRYOGENIC RECTIFICATION SYSTEM

[75] Inventor: Neno T. Nenov, Williamsville, N.Y.

[73] Assignee: Praxair Technology, Inc., Danbury, Conn.

[21] Appl. No.: 260,272

[22] Filed: Jun. 14, 1994

[51] Int. Cl.[6] ..... F25J 3/00; F25D 25/00; F01D 9/00; F01D 25/00

[52] U.S. Cl. ..... 62/36; 62/39; 62/40; 415/186

[58] Field of Search ..... 62/39, 36, 40; 415/186, 191, 208.3, 211.1

[56] References Cited

U.S. PATENT DOCUMENTS

| | | | |
|---|---|---|---|
| 1,024,391 | 4/1912 | Boltshauser | 415/191 |
| 1,266,973 | 5/1918 | Metten | 415/191 X |
| 2,641,442 | 6/1953 | Büchi | 415/191 |
| 2,822,974 | 2/1958 | Mueller | 415/186 X |
| 2,845,216 | 7/1958 | Sallou | 415/191 X |
| 3,058,787 | 10/1962 | Bernson | 308/121 |
| 4,054,398 | 10/1977 | Penny | 415/208.3 |
| 4,566,166 | 1/1986 | Donelson | 415/191 X |
| 4,815,935 | 3/1989 | Gottemoller | 415/211.1 |
| 4,978,278 | 12/1990 | Kun | 415/144 |
| 5,046,919 | 9/1991 | Wulf | 415/1 |
| 5,178,516 | 1/1993 | Nakagawa et al. | 415/208.3 |
| 5,207,565 | 5/1993 | Roessler | 417/407 |
| 5,214,920 | 6/1993 | Leavesley | 60/602 |
| 5,222,365 | 6/1993 | Nenov | 62/39 |
| 5,228,298 | 7/1993 | Kun et al. | 62/39 |
| 5,299,909 | 4/1994 | Wulf | 415/186 |
| 5,341,647 | 8/1994 | Koeberle et al. | 62/39 |

*Primary Examiner*—Christopher Kilner
*Attorney, Agent, or Firm*—Chung K. Pak; Douglas E. Denninger

[57] ABSTRACT

A turboexpander, particularly suited for use in a cryogenic rectification system, comprises a center housing rotatably supporting an elongated shaft to opposite ends of which are mounted a turbine wheel within a turbine housing and a compressor wheel within a compressor housing or a brake within a load housing. The turbine wheel has circumferentially spaced turbine blades. Process fluid is introduced so as to flow through annular nozzles or guide vanes which encompass the turbine wheel. The guide vanes direct the process fluid through the turbine blades and each extends between a leading edge more distant from the turbine wheel and a trailing edge less distant from the turbine wheel. Each guide vane is substantially uncontoured between its leading edge and the trailing edge and is substantially thicker at the leading edge than at the trailing edge. A thermal shield thermally isolates the turbine housing and the process fluid within the turbine housing from the central housing and the lubricant within said central housing. A labyrinth seal construction along the length of the shaft between the bearings and the turbine housing prevents migration of the lubricant along the shaft into the turbine housing and prevents migration of the process fluid out of the turbine housing along the shaft and into the central housing. Sealing gas may also be provided to the labyrinth seal construction as an additional expedient to prevent migration of the lubricant along the shaft and of the process fluid out of the turbine. Superior performance is achieved by the relative dimensioning of certain components.

25 Claims, 8 Drawing Sheets

EXPANSION TURBINE FOR CRYOGENIC RECTIFICATION SYSTEM

BACKGROUND OF THE INVENTION

1. Field of the Invention

The present invention relates generally to expansion turbines and, more particularly, to an expansion turbine for producing refrigeration or for use in cryogenic rectification of feed air to produce nitrogen and other gases.

2. Background of the Invention

Industrial gases such as nitrogen and oxygen are produced commercially in large quantities by the cryogenic rectification of feed air. Refrigeration to drive the cryogenic rectification is provided by the turboexpansion of a compressed process stream which is generally either a compressed feed air stream or a high pressure stream taken from the rectification column. The turboexpander of an air separation plant is a costly piece of equipment to operate and maintain and it would be desirable to reduce such costs.

Indeed, the initial cost of turboexpanders used in nitrogen producing facilities represents a sizeable portion of the capital cost of the plant itself. For a small size plant, the cost of the turbine is in the order of 10% of the total plant cost. Reducing the initial cost of the turboexpanders for these applications, then, is desirable for improving the overall plant cost effectiveness. On the other hand, the relative importance of turboexpander performance, or efficiency, cannot be overlooked. Hence, it becomes a classic problem of performance versus cost. Ideally, one would like to have a high performance machine at low cost or, more realistically, a tradeoff between cost and performance. This invention solves the dilemma by offering a low cost machine with reasonable performance, that is, with a machine efficiency up to mid-eighties percent.

Production of nitrogen or oxygen gas through separation of air by cryogenic distillation require use of cryogenic turboexpanders, the design of which is very similar, functionally, to that of a turbocharger. For example, both applications require a turbine stage and a compressor stage connected by a rotatable shaft, mounted in a bearing housing. However, turbochargers, unlike cryogenic turboexpanders, are typically operated at elevated temperatures. This is natural, because the turbocharger was developed to use the exhaust gases discharged from an internal combustion engine as a propellant gas to rotate the turbine wheel, mounted at one end of a shaft. A compressor wheel is mounted at the other end of the shaft, and is turned by the turbine wheel to compress air, which is then communicated to the engine, thereby supplying charge air to the engine for increasing engine performance. The initial cost of a typical turbocharger used in an internal combustion engine is relatively low, because of the advantages of series production. The initial cost of a cryogenic turboexpander, on the other hand, is generally one or two orders of magnitude higher.

There have not previously been significant attempts to solve the cost problem technologically, except through market pressures of supply and demand. Established existing vendors of cryogenic turboexpanders were the suppliers of these machines. More specifically, one could obtain from vendors a lower efficiency machine at a modest cost, or have a high efficiency machine built at high cost. This invention offers an attractive alternative of a low cost machine with modest-to-high performance.

As stated above, the initial cost of the turbine remains prohibitively high. For a small nitrogen product plant useful for producing approximately 25 tons per day for example, the turbine initial cost may be more than 10% of the total plant first cost. The prior art solution to the problem has been technologically deficient, because it offers either high performance at high cost or low performance at modest cost. A machine of modest performance and low cost has not been available.

The use of mass produced subcomponents for constructing an efficient and low cost turboexpander for cryogenic air separation plants has been considered. This approach led to the use of a modified diesel engine turbocharger as a cost effective cryogenic turboexpander. A standard diesel engine turbocharger comprises a turbine stage, rotor, bearings, housing, and a compressor stage. For cryogenic air separation applications, at the minimum, the turbine stage of the turbocharger must be modified to render it suitable for low temperature (cryogenic) service. A turbocharger is customarily designed to operate with hot (above 1,000° F.) exhaust gases of an internal combustion engine. Its application as a cryogenic turboexpander, operating at very low temperatures (below −200° F.), is not only unobvious but even thought impossible, because of the materials of construction, sealing and other constraints.

A primary advantage of the invention resides in its low initial cost which is an order of magnitude less expensive than the current commercially available state-of-the-art turboexpanders. The low cost is possible because of the advantages of series production of turbochargers. An existing turbocharger, however, cannot be used, as is, without embodying the modifications disclosed herein to render it suitable for the cryogenic application. Another advantage is simplicity of design and, associated with it, inherent reliability. Nor do these modifications compromise the performance of the turbine. To the contrary, while the efficiency of the turboexpander of the invention does not exceed existing state-of-the-art turboexpander machinery, the achievable isentropic efficiency in the mid-eighties percent is an excellent combination of low initial cost and relatively good performance resulting in an overall cost advantage over existing state-of-the-art technology. This advantage has merit in many diverse cryogenic plants using a variety air separation cycles.

A primary object of this invention is to provide a low cost turboexpander, which may be effectively employed in a cryogenic production cycle. It is another object of this invention to provide a cryogenic production cycle which can effectively employ such a low initial cost turboexpander of reasonable efficiency.

As indicated, the cryogenic turboexpander of the invention is a rugged machine, with both low initial and maintenance cost and high reliability. Its operating efficiency with a modified turbine wheel is reasonably acceptable for the nitrogen producing plants with waste expansion or air expansion. Some applications, such as oxygen producing air separation plants, or even smaller nitrogen producing plants, may require the use of a state-of-the-art design turbine wheel, which is attached to the rotor instead of the trimmed expander wheel of the original turbocharger, the use of which may be prohibitive because of intolerably low turboexpander efficiency. Even in this situation, however one can obtain the benefits of low machine and maintenance costs.

The low cost turboexpander of this invention can be utilized in plants and cycles producing oxygen and/or nitrogen through separation of air by cryogenic distillation. The machine is especially suited for nitrogen producing plants through separation of air by cryogenic distillation with either a waste expansion or an air expansion cycle. It can be also used in other cryogenic processes, such as hydrogen, natural gas, or similar chemical processes requiring an expansion engine of low first cost and reasonable performance.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE INVENTION

Figure 1:
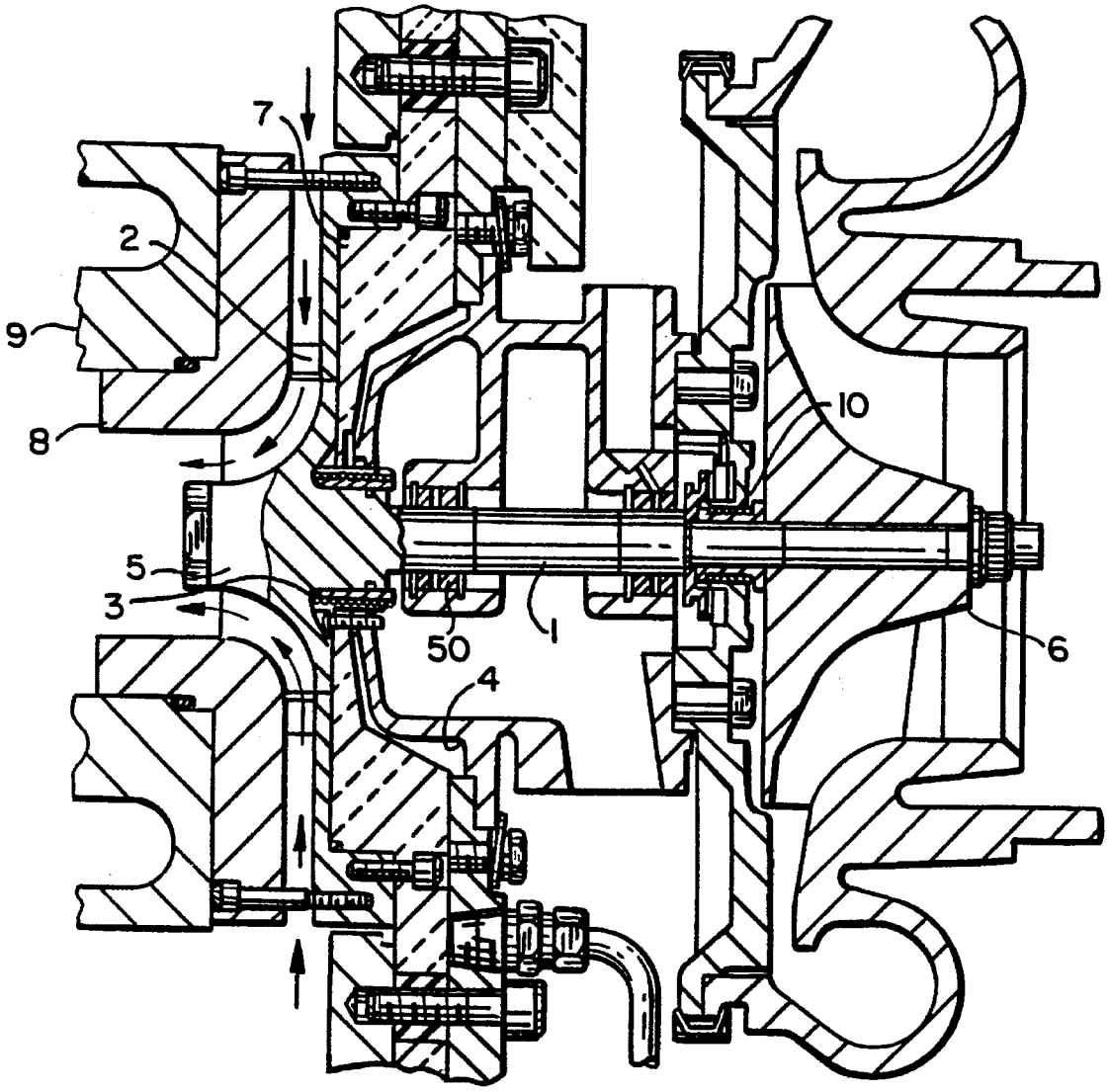
FIG. 1 is a cross sectional assembly view of a cryogenic turboexpander embodying one embodiment of the present invention.

Turn now to the drawings and initially to FIG. 1 which is a cross sectional assembly view of the cryogenic turboexpander of the invention.

A rotor or shaft 1 of the machine rotates in the bearing housing 4 which also retains the turbine end shaft seal 3, the compressor end shaft seal 10, nozzle guide vanes 2 and thermal shield 7. The turbine wheel 5 may be an integral part of the shaft 1 or it may be made as a separate part and attached to the shaft similarly as the compressor wheel 6, attached at the other end of the shaft. The nozzle guide vanes 2 are an integral part of ring situated circumferentially and in close proximity of the turbine wheel 5 and attached to the thermal shield 7.

The thermal shield 7 is provided to insulate the cold turbine wheel region (and the process gas) from the warm regions of the bearing housing. This is necessary for two reasons: first, to protect the lubricant in the bearings from freezing, which would jeopardize the machine functionality; and second, to prevent heat from leaking into the process fluid, which would unnecessarily reduce the turboexpander efficiency and performance. To keep the cost low, the turbine wheel can be obtained from the original turbine wheel by trimming its outside diameter and its tip stream line, which is then mated with the stationary shroud 8, attached also to the bearing housing 4 via the ring for the nozzle guide vanes 2 and the thermal shield 7.

The turboexpander housing 9 provides means for the process fluid introduction and exit from the herein described turboexpander. The turboexpander is loaded by a compressor wheel 6 and compressor stage, which operates in a heat rejection loop, where the work of compression is usually rejected via a heat exchanger into the plant cooling system. In some instances it may be advantageous to utilize the turboexpander work by integrating it with the process, for example by compressing the nitrogen product or other stream of the process cycle.

Figure 2:
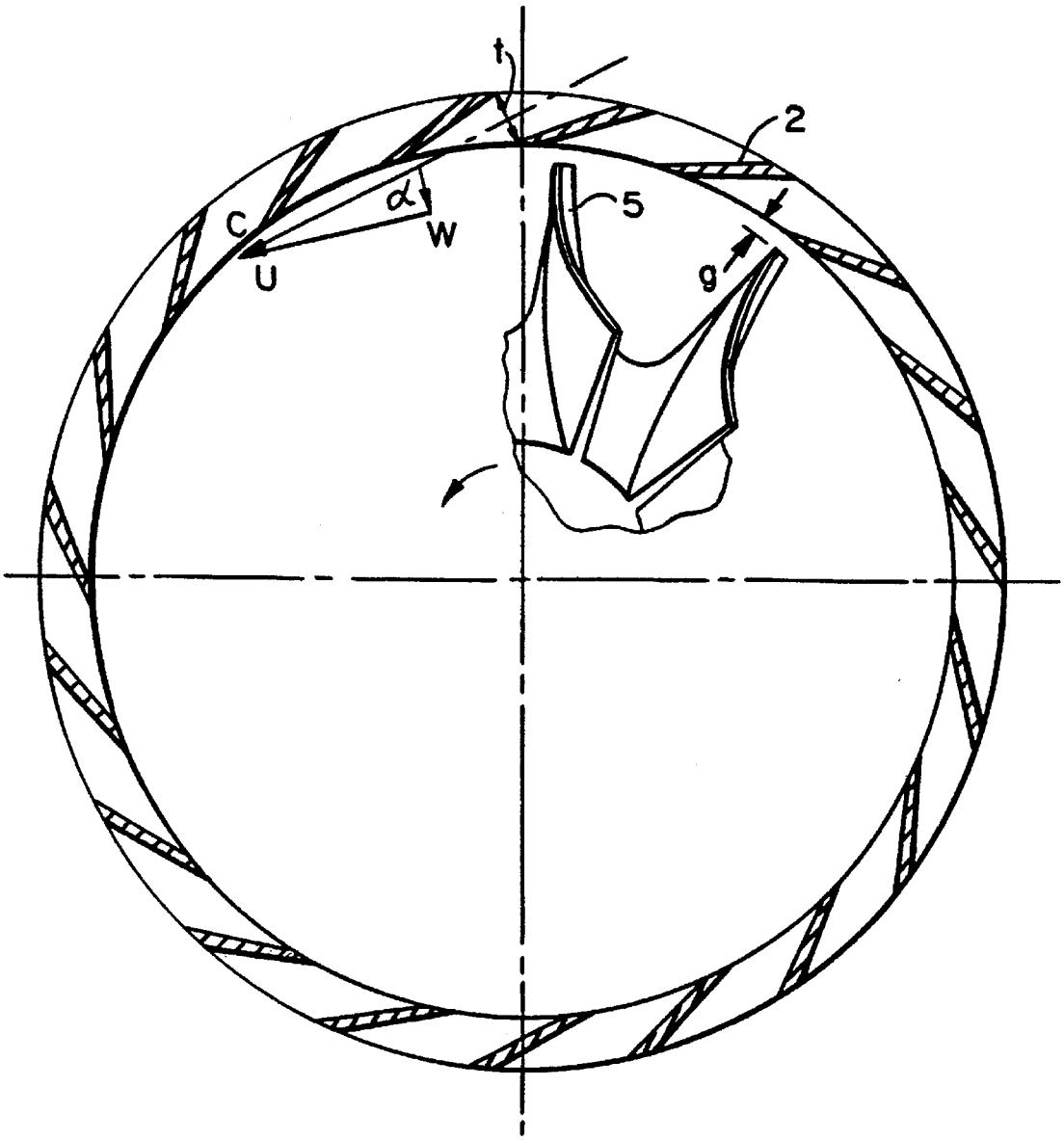
FIG. 2 is a detailed cross section view taken generally along line 2—2 in FIG. 1 and illustrating a detail of the nozzle guide vane assembly and of the turbine wheel, which are one embodiment of the invention.

FIG. 2 shows a detail of the nozzle guide vane assembly 2 of FIG. 1. The nozzle guide vanes are machined on a ring which is situated in a close proximity to the outer periphery of the turboexpander wheel. Its function is to guide the propellant gas into the turboexpander wheel by introducing it almost tangentially to the impeller itself. The propellant gas is accelerated to an absolute velocity C in the nozzle, which has a tangential component U and a radial component W.

Although variable nozzles can be used, it is not essential to do so. In fact it is preferable, in order to keep costs low, to use very simple guide vanes machined integrally and situated on a ring surrounding the impeller itself. Existing design practices, by the conventional wisdom of those skilled in the art, suggest that the vaneless gap g shown on FIG. 2, defined by the difference of the nozzle trailing edge radius and the wheel radius, is in the order 5% to 7% of the turboexpander wheel radius. This is done to allow enough length of gas path for the flow to develop into a more uniform pattern at the point of admission at the impeller. On the other hand, it should not be too large, because this is the region of highest skin friction losses since the absolute velocity of the gas is highest in the vaneless nozzle space and these losses increase with the square of the gas velocity.

In fact, as it can be appreciated by those skilled in the art, (see Eq. 4.52, page 178 of the publication "Design Of Radial Turbomachines" by A. Whitfield and N. C. Baines, Longman Scientific and Technical Publishers, U.K., copy enclosed), the best efficiency is to be obtained at a nozzle trailing edge radius of 5.4% larger than the wheel diameter. In contradiction with this existing design practices, the nozzle trailing edge radius of the present invention is approximately 1% to 4%, preferably about 2% to 3%, larger than the turboexpander wheel diameter. This specially designed nozzle trailing edge radius coupled with a nozzle cord length, which is also shorter than that suggested by existing design practices, produces a compact design with desired performance results. The simple nozzle ring design of FIG. 2 affords more easily, at a lower cost, a larger number of nozzle guide vanes than a more traditional, and more expensive, variable nozzle design. The larger number of nozzles also produces a more compact machine at a lower cost.

In order to accommodate dimensional constraints required for the uses described herein, components and their sizes utilized in conventional, commercially available, turbochargers were modified. These modifications were found to result in unanticipated improvements in the performance of the resulting turboexpander. These performance improvements will be better appreciated after reviewing FIGS. 8 and 9 below and the accompanying text. However, at this point in the disclosure, it is deemed desirable to relate various conventional relationships between a diameter of the turboexpander wheel and a chord length of the nozzle guide vanes 2 where the chord length is the distance between the leading edge and the trailing edge. Table 1 which follows presents a number of such conventional relationships and dimensioning of a turboexpander according to the present invention:

TABLE 1

| SOURCE | TURBINE WHEEL DIAMETER, INCHES | GUIDE VANES CHORD, INCHES |
|---|---|---|
| Invention | 4.400 | 0.500 |
| Praxair earlier design | 4.560 | 2.190 |
| Praxair, earlier design | 5.170 | 1.404 |
| Praxair earlier design | 7.412 | 4.500 |
| Linde A.G. | 6.000 | 1.000 |
| Linde A.G. | 6.000 | 1.800 |

For purposes of the invention, it has been found desirable for the chords length to be in the range of approximately 5% to 15%, preferably 8% to 14%, of the wheel diameter and for the gap g between the trailing edges of the guide vanes 2 and the outer periphery of the turbine wheel 5 to be in the approximate range of 1% to 4%, preferably 2% to 3%, of the turboexpander wheel radius. The gap g may vary, for example, from 0.05 inch and 0.50 inch, depending on the length of the turboexpander wheel radius.

The size of the throat area, t, between the nozzle guide vanes is the primary variable for flow control, and therefore capacity, of the machine. The nozzle vanes are of a very simple design as depicted on FIG. 2, although a traditional and more sophisticated nozzle design can also be used, if it can be obtained at a sufficiently low cost.

Figure 3:
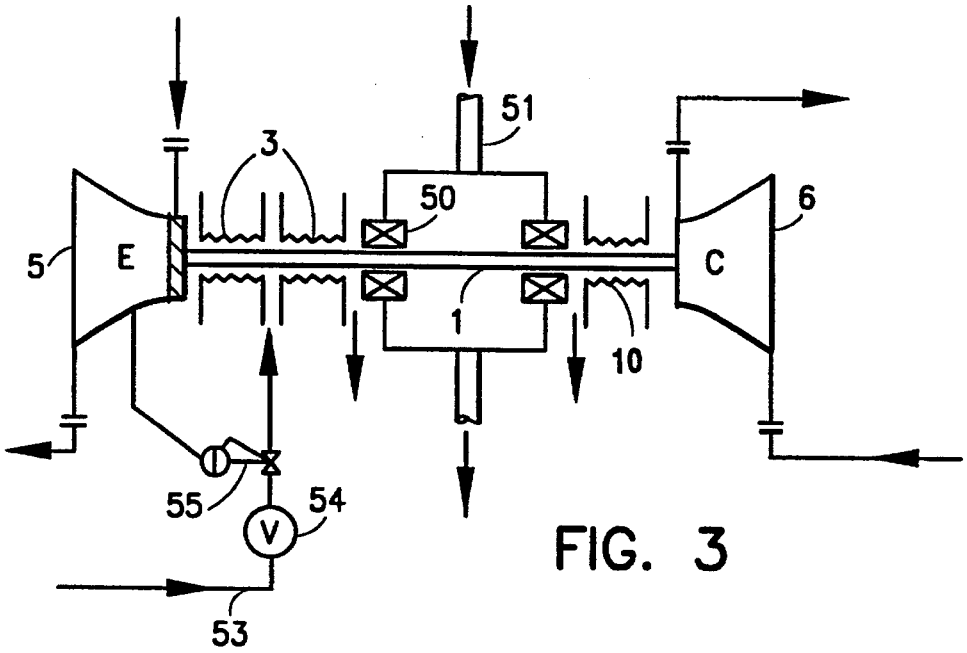
FIG. 3 is a diagrammatic cross sectional view illustrating the details of the shaft seal system of the cryogenic turboexpander which is one embodiment of the invention.

FIG. 3 is a schematic cross-sectional view of the details of the shaft seal system of the cryogenic turboexpander of this invention, which enable its effective use in a cryogenic rectification plant or air separation cycle. With reference to FIG. 3, the turboexpander comprises a turbine wheel 5 being an integral part with or mounted at one end of shaft 1. The compressor wheel 6 is mounted at the opposite end of the shaft 1. The shaft, connecting the turbine wheel and the compressor wheel, rotates in bearings 50, situated in close proximity of each wheel and separated from the wheels by shaft seals.

Lubricant such as oil is provided to the bearings 50 though a line 51. Bearing lubricant migration to the cold process fluid is prevented by the shaft seal system as illustrated in FIG. 3. A suitable seal system is provided to contain the sealing gas around the shaft. The seal system typically comprises labyrinths 3 which creates a series of localized pressure buildups along the shaft 1, countering the flow of lubricant from bearing to impeller 5 and cold process gas from turbine wheel to bearings. This effectively isolates bearings from process stream, thereby assuring reliable turboexpander operation without oil lubricant freeze-up in the bearings.

Sealing gas may be provided to the seal system and is preferably the same as the process stream, e.g., waste nitrogen or feed air. In the arrangement illustrated in FIG. 3, the sealing gas, which is at a warm temperature, typically within the range of from 40 deg. F to 150 deg. F, is passed in line 53 through valve 54. Regulator 55 senses the pressure near the turbine wheel at the point of seal gas entry and regulates the seal gas flow. The sealing gas is provided to the seal system between the bearing housing and the bearing proximate the housing. By "proximate the housing" is meant nearer to the housing than to the bearing, between the thermal shield and the housing. The seal gas is withdrawn with the return lubricant oil. The warm temperature of the sealing gas also serves to prevent any lubricant retained on the shaft from freezing due to the cryogenic temperature of the process fluid. Some warm sealing gas may flow into turboexpander housing 9. This would cause an efficiency loss as it mixes with the cold process fluid. However, this efficiency loss is tolerable when considered in the context of the substantial gains provided by this invention.

As can be appreciated by one skilled in the art, this seal gas arrangement is necessary only at the turbine end of this cryogenic turboexpander. There is no seal gas required on the other, compressor end of the shaft 1. Instead, the compressor loop process gas, such as air or nitrogen, is allowed to escape through the similar labyrinth shaft seal 10.

Figure 4:
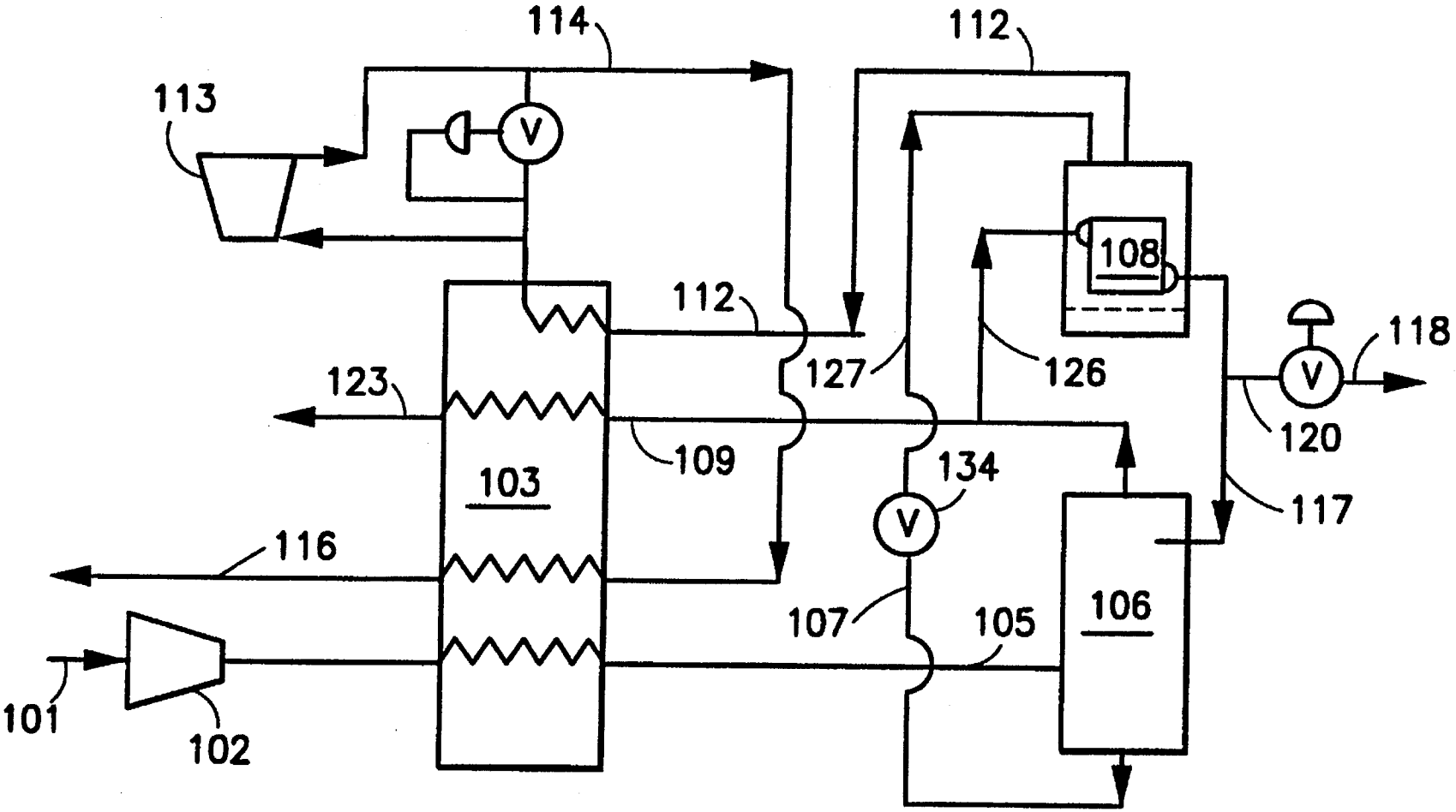
FIG. 4 is a schematic diagram representing one embodiment of a waste expansion cryogenic nitrogen production system utilizing the turboexpaner of FIGS. 1 and 3, which is another embodiment of the invention.

FIG. 4 represents one particular embodiment of a waste expansion cryogenic nitrogen production system and is presented for illustrative purposes. The invention may be employed with any suitable cryogenic rectification plant. It is particularly useful in a waste expansion cryogenic nitrogen production cycle wherein a waste stream from a rectification column is expanded to generate refrigeration and the expanded waste stream is passed in indirect heat exchange with incoming feed air to cool the feed air and thus provide refrigeration into the rectification column system to drive the rectification.

With reference to FIG. 4, feed air 101 is compressed in base load feed air compressor 102 and then passed through main heat exchanger 103. Within main heat exchanger 103, the compressed feed air is cooled by indirect heat exchange with expanded waste fluid as will be discussed in greater detail later. The compressed and cooled feed air, which is also cleaned of high boiling impurities such as water vapor and carbon dioxide, is then passed as stream 105 into a cryogenic rectification column system.

The cryogenic rectification column system illustrated in FIG. 4 comprises a single column 106 and a top condenser 108. It is preferred in the practice of this invention that the cryogenic rectification plant comprise one column although plants comprising more than one column may be employed. Column 106 preferably is operating at a pressure within the range of from 40 to 140 psia.

Within column 106, the feed air is separated by cryogenic rectification into a nitrogen vapor product and a nitrogen-containing liquid. The nitrogen vapor product is withdrawn from the upper portion of column 106 generally having a purity in the range of 98% nitrogen to 99.9999% nitrogen, or greater. A stream 26, being a portion of the nitrogen vapor product in line 109, is passed into top condenser 108 wherein it is condensed against nitrogen-containing liquid and then passed as stream 117 back into column 106 as reflux. If desired, a portion 120 of stream 117 may be recovered as liquid nitrogen product in line 118. Nitrogen containing liquid, having a nitrogen concentration generally within the range of from 60 to 70%, is removed from the lower portion of column 106 as stream 107, reduced in pressure through valve 134, and passed as stream 127 into top condenser 108 wherein it boils to carry out the condensation of stream 126.

The withdrawn nitrogen vapor product in line 109 is warmed by passage through main heat exchanger 103 in indirect heat exchange with feed air thereby cooling the feed air. Thereafter, the warmed nitrogen vapor product is recovered via line 123. If desired, the warmed nitrogen product may be compressed by passage through a compressor and resulting high pressure nitrogen product may then be recovered.

Nitrogen-containing waste fluid is withdrawn from top condenser 108 of the rectification column system as stream 112 which then partially traverses main heat exchanger 103 and is then expanded through an improved turboexpander 113, according to the invention, to a pressure within the range of from 20 psia to atmospheric pressure. The turboexpander 113 may be coupled to a nitrogen product compressor if it is used. In such a directly coupled turbine-compressor system, both devices are connected mechanically with or without a gear system so that the energy extracted from the expanding gas stream is passed directly by the turbine via the compressor to the compressed product nitrogen gas. This arrangement minimizes both extraneous losses and capital expenditures associated with an indirect energy transfer from the turbine to the compressor via an intermediate step of, for example, electrical generation. As waste fluid 112 passes through turboexpander 113, it drives the turboexpander which then drives a compressor. Simultaneously, the expanding waste fluid is cooled by passage through the turboexpander 113.

Cooled, expanded waste fluid 114 is then warmed by passage through main heat exchanger 103 in indirect heat exchange with feed air to carry out cooling of the feed air thus providing refrigeration into the cryogenic rectification column system with the feed air to drive or carry out the cryogenic rectification. The resulting warmed waste fluid is removed from the main heat exchanger 103 as stream 116.

Figure 5:
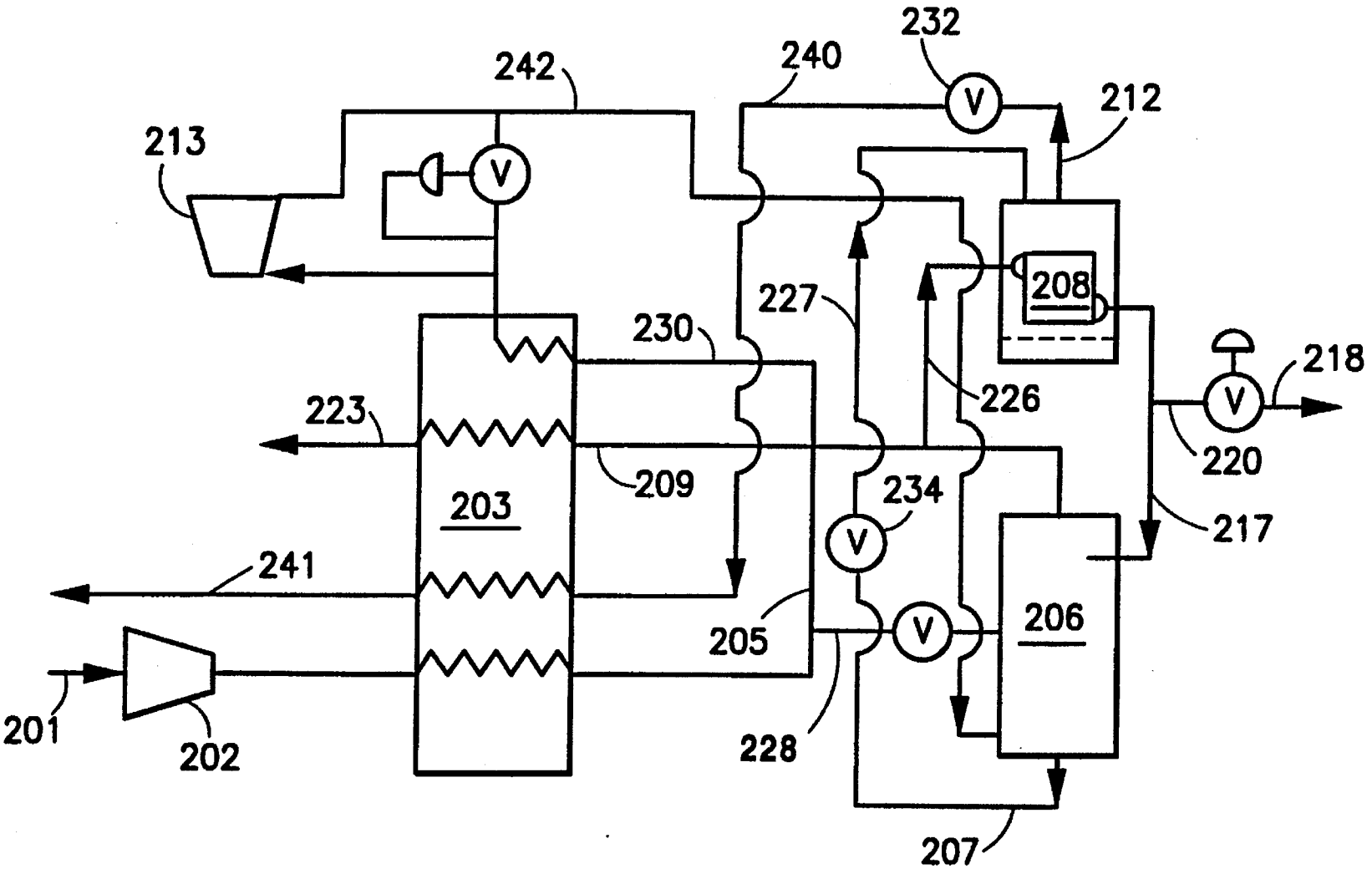
FIG. 5 is a schematic diagram, similar to FIG. 4, depicting an air expansion cryogenic nitrogen production system utilizing an air expansion cycle, which is another embodiment of the invention.

An air expansion cycle is illustrated in FIG. 5. The numerals in FIG. 5 generally correspond to those of FIG. 4 but are 200-series numbers instead of 100-series numbers such that the elements common to both cycles will not be discussed again in detail.

With reference to FIG. 5, waste fluid stream 212 is withdrawn from top condenser 208, reduced in pressure through valve 232 and the resulting stream 240 is warmed by passage through main heat exchanger 203 in indirect heat exchange with compressed feed air and then removed from the system as stream 241. Cooled, compressed feed air 205 is passed at least in part through improved turboexpander 213 according to the invention. In the embodiment illustrated in FIG. 5, a portion 228 of the cooled compressed feed air is passed directly into column 206 and another portion 230 partially traverses main heat exchanger 203 and is then expanded through the turboexpander 213. The portion of the cooled, compressed feed air which is expanded through turboexpander 213 may be within the range of from 90 to 100% of the cooled, compressed feed air. In the case where 100% of the cooled, compressed feed air is passed through turboexpander 213, stream 228, as illustrated in FIG. 5, would not be present.

As the feed air passes through turboexpander 213, it drives the turbine which then may drive the compressor to compress nitrogen product. Simultaneously, the expanding feed air is cooled by passage through turboexpander 213. Cooled, expanded feed air 242 is then passed from the turboexpander 213 into column 206 of the cryogenic rectification plant thus providing refrigeration into the cryogenic rectification plant to drive or carry out the cryogenic rectification.

Figure 6:
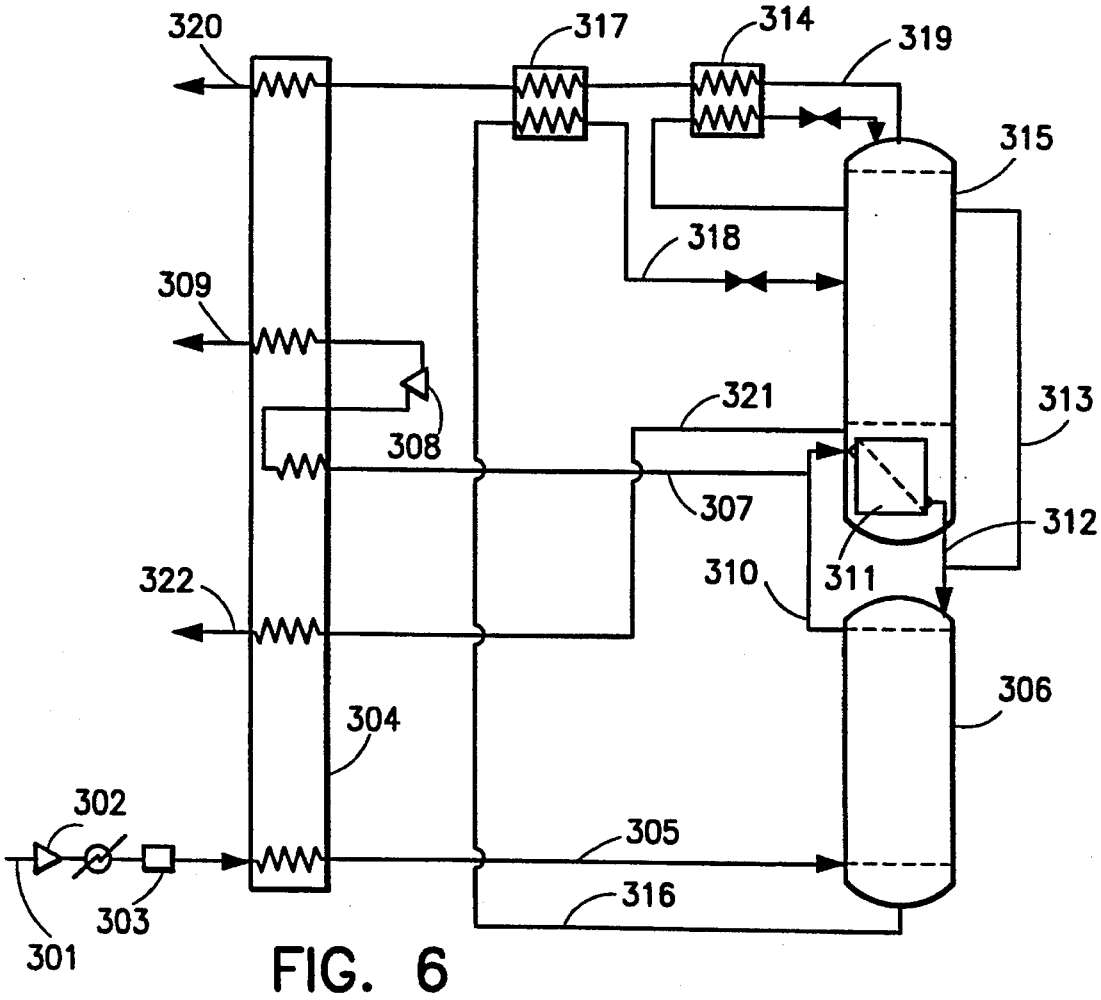
FIG. 6 is a schematic diagram, similar to FIGS. 4 and 5, depicting one embodiment of a gaseous oxygen and nitrogen production system utilizing the turboexpander of FIG. 1 and/or 3 which is another embodiment of the invention.

FIG. 6 represents one particular embodiment of a gaseous oxygen production cycle presented for illustrative purposes. The invention may be employed with any suitable cryogenic rectification plant. It is particularly useful in an oxygen producing plant with either upper column air expansion or, as shown on FIG. 6, with shelf nitrogen expansion, wherein a waste nitrogen stream from a rectification column is expanded to generate refrigeration. The expanded waste stream is passed in indirect heat exchange with incoming feed air to cool the feed air and thus provide refrigeration into the rectification column system to drive the rectification.

With reference to FIG. 6, feed air 301 is compressed in base load feed compressor 302, precleaned from impurities in prepurifier 303, and then passed through main heat exchanger 304. Within main heat exchanger 304, the compressed feed air is cooled by indirect heat exchange with the product and other return cold streams as will be discussed in greater detail later. The compressed and cooled feed air is then passed as stream 305 into the lower column 306 of a cryogenic rectification column system.

The cryogenic rectification column system illustrated in FIG. 6 comprises lower column 306, upper column 315, and a main condenser 311. Lower column 306 preferably is operating at a pressure within the range of from 40 to 140 psia. Within lower column 306, the feed air is separated by cryogenic rectification into waste nitrogen vapor and oxygen enriched liquid. A portion 310 of nitrogen vapor is passed into the top of the main condenser 311 wherein it is condensed against boiling oxygen liquid of the upper column and then passes as stream 312 back into lower column 306 as reflux.

Nitrogen-containing liquid, having a nitrogen concentration generally within the range of from 60 to 70 percent, is removed from the lower portion of lower column 306 as stream 316, warmed up in heat exchanger 317 against product or waste nitrogen stream 320, reduced in pressure and passed as stream 318 into the upper column 315. The upper column preferably is operating at a pressure within the range of 15 to 25 psia. Oxygen product is removed from the main condenser liquid as stream 321, which is warmed up against the feed air in the main heat exchanger 304 and withdrawn as gaseous oxygen product stream 322.

Nitrogen waste fluid is withdrawn from the recirculating high pressure vapor stream of the main condenser 311 as stream 307, partially warmed by the feed air in one of the main heat exchanger 304 passages, and then expanded into turboexpander 308 to produce required refrigeration to sustain the rectification process. The cooled, expanded waste fluid stream is then warmed by passage through main heat exchanger 304 in indirect heat exchange with feed air to carry out the cooling of the feed air to drive or carry out the cryogenic rectification. This resulting warm nitrogen stream is removed from main heat exchanger 304 and discharged as waste stream 309.

Another nitrogen stream 313 is withdrawn from the returning nitrogen condensate stream 312 from the main condenser and injected as reflux into the hat of the upper column after partial warm-up in the heat exchanger 314. This reflux stream is necessary to drive the upper low pressure rectification column to produce high purity nitrogen and oxygen product.

By the use of the improved turboexpander of this invention, one can produce nitrogen or oxygen employing cryogenic rectification with lower machine and operating costs without experiencing a high cost penalty in order to obtain moderate efficiency.

Figure 7:
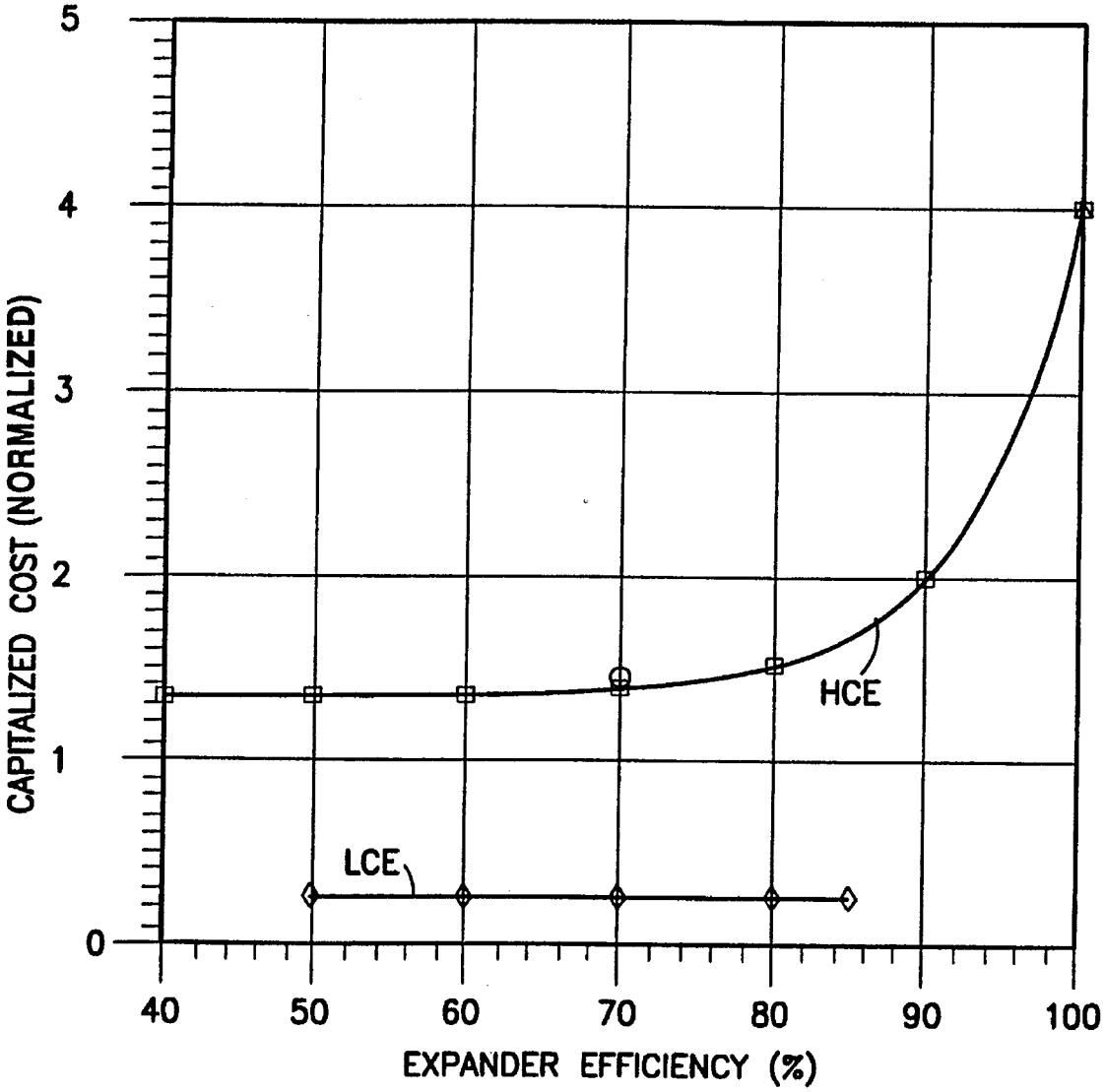
FIGS. 7, 8 and 9 are all graphs depicting the cost advantages of the turboexpaner of FIG. 1 when employed in a cryogenic air separation system.

FIG. 7 shows the advantage of the low cost machine of this invention as it relates to nitrogen producing plants utilizing waste expansion through the turboexpander for producing refrigeration to self sustain the plant. For a cycle such as that depicted in FIG. 4, there is no additional capitalized power cost or penalty associated with lower turboexpander efficiency. In fact, an turboexpander with efficiency as low as 40% will provide sufficient refrigeration to sustain the cycle operation for this type of nitrogen producing plant.

Hence, it follows that an turboexpander with low capitalized cost (that is, the sum of its initial cost plus its operating cost) will offer a cost advantage over a more expensive turboexpander of the same or superior efficiency. This is graphically illustrated in FIG. 7, for a 50 ton per day nitrogen producing plant, where the low cost turboexpander (denoted as line LCE with the diamond data points) offers approximately 73% savings over the higher cost machine (denoted as curve HCE with the square data points) at 50% efficiency of the turboexpander. At 85% turboexpander efficiency, the cost advantage increases to 83%. Moreover, it has been discovered that there exists a range of lower efficiencies in which the turboexpander of the present invention could be operated more advantageously over the existing state-of-art turboexpanders as indicated by FIGS. 7, 8 and 9 and in Table 2 below:

TABLE 2

| PRODUCT | CYCLE | EXPANDER EFFICIENCY RANGE % (THE INVENTION) | EXPANDER EFFICIENCY RANGE % (CURRENT PRACTICE) |
|---|---|---|---|
| NITROGEN | WASTE EXPANSION (FIG. 4) | 40%–85% | 75%–90% |
| NITROGEN | AIR EXPANSION (FIG. 5) | 40%–85% | 70%–90% |
| OXYGEN (PLUS NITROGEN) | CYCLE SHOWN IN FIG. 6 | 65%–85% | 75%–92% |

Figure 8:
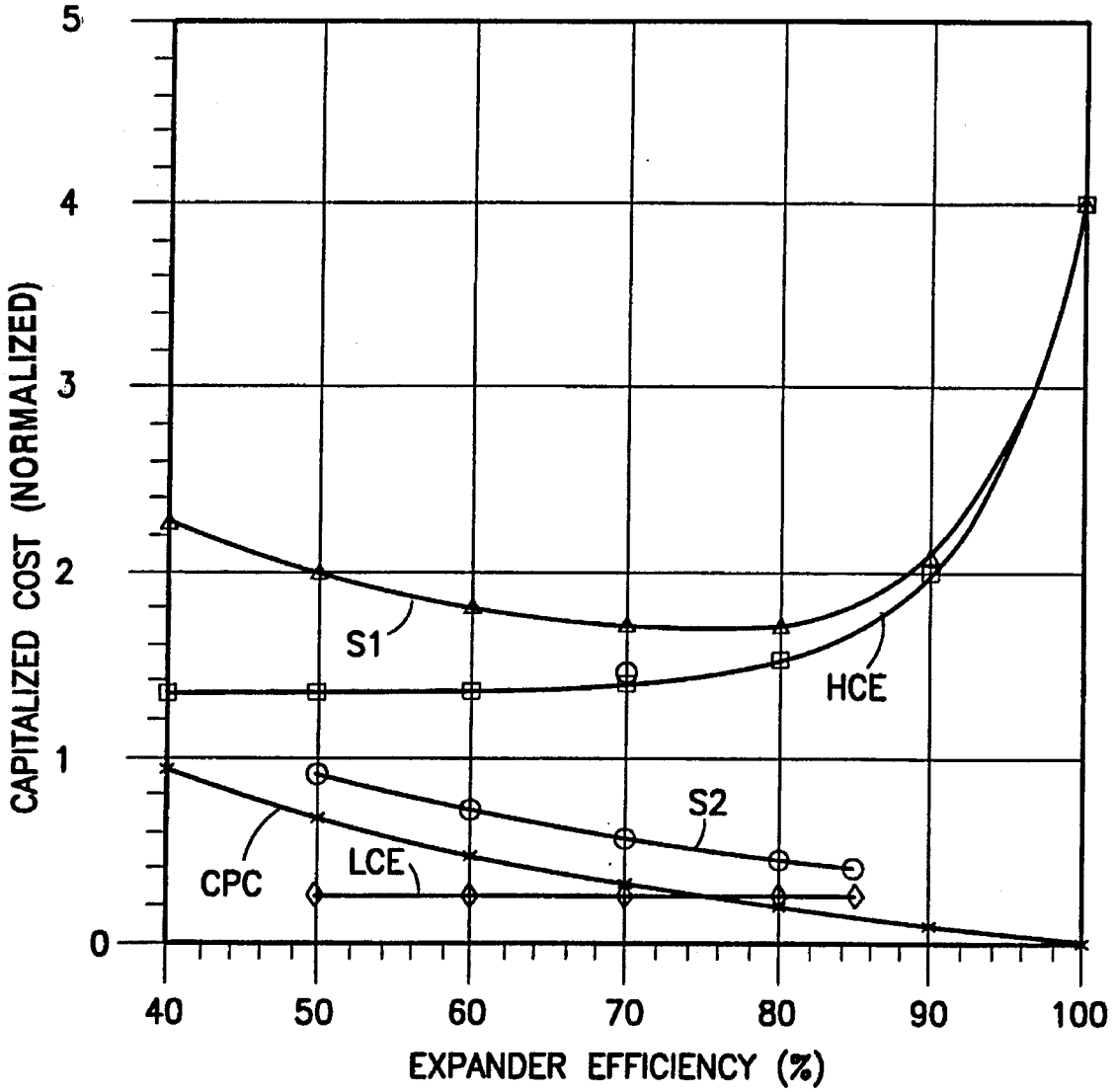
Figure 9:
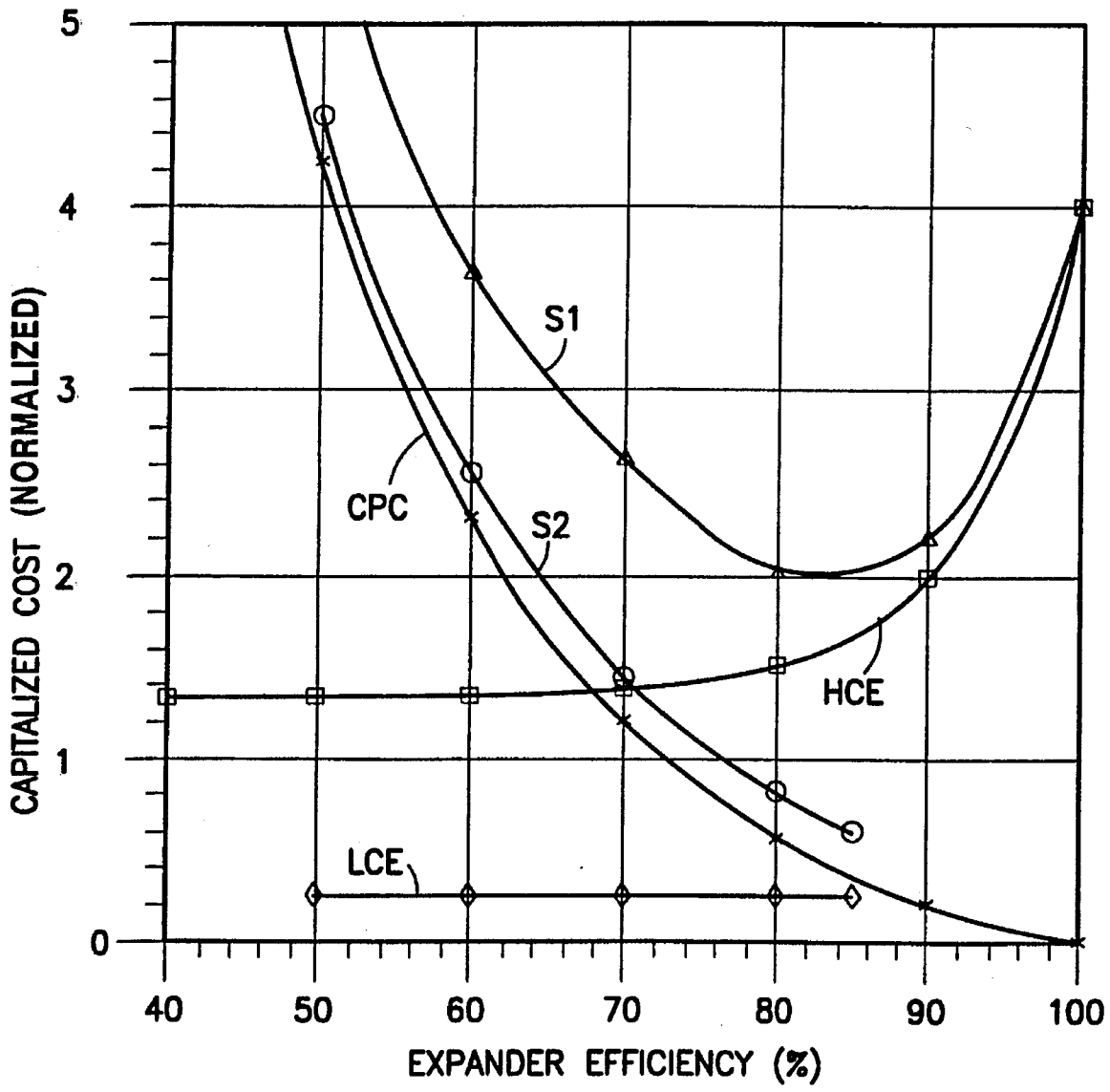

The economic advantage of the lower cost turboexpander, as it pertains to nitrogen gas producing plants utilizing an air expansion cycle for producing refrigeration to self sustain the plant, is graphically illustrated in FIG. 8 for a 50 ton per day nitrogen producing plant. The associated plant cycle for the graph of FIG. 8 is shown in FIG. 5. As can be seen, in the air expansion cycle, there is a sharp increase in the capitalized cost as the turboexpander efficiency drops from 100% to 40%.

The capitalized cost of 100% point turboexpander efficiency in FIGS. 7, 8 and 9 represents the dollar value (at 25 cents per 100 cubic feet of gas as liquid equivalent) of the imported nitrogen required to add to the plant as liquid to produce required refrigeration in order to sustain plant operation. In case of the air expansion cycle of FIG. 8, again, the low cost turboexpander of the present invention is denoted as line LCE with the diamond data points, whereas the state-of-the-art higher cost machine is denoted as curve HCE with the square data points. Curve CPC, with the snow flake data points, denotes the additional capitalized power cost required to operate the air expansion cycle over the power required to operate the plant at the reference point of 100% turboexpander efficiency, corresponding to plant operation with liquid nitrogen addition for refrigeration.

With continued reference to FIG. 8, curve S1, with the triangular data points, is seen as the sum of the high turboexpander cost (curve HCE, square data points) and the additional capitalized power cost (curve CPC, snow flake data points). Curve S1 is representative of the total cost associated with the use of the state-of-the-art high performance turboexpander in the nitrogen producing gas plants with air expansion cycle as shown in FIG. 5. As can be seen, an optimum, lowest cost, operation corresponds to an turboexpander efficiency of 70% to 80% for this case. On the other hand, curve S2 with the circular data points is the sum of the lower cost turboexpander of the present invention (denoted as line LCE with the diamond data points) and the additional capitalized power cost (curve CPC, snow flake data points).

As can be seen, the use of the lower cost machine of the present invention, as represented by curve S2, offers a significant cost advantage over the state-of-the-art higher cost turboexpander. This cost advantage spans the entire efficiency range from 40% to 85%. Although the savings diminish with decreased turboexpander efficiency, at the optimum point of 80% efficiency, (corresponding to minimum capitalized cost with use of the higher cost machine), the present invention offers about 70% cost savings over the higher cost expander.

The economic advantage of the lower cost turboexpander as pertains to the yet another type of cryogenic air separation plants, for producing of gaseous oxygen, is graphically illustrated in FIG. 9. This pertains to a 20 ton per day gaseous oxygen production plant. An associated plant cycle is shown in FIG. 6. As can be seen, such oxygen producing plants are characterized with an even sharper increase of the capitalized cost addition due to the inefficiency of the turboexpander, as the turboexpander efficiency drops from 100% to 40%.

The capitalized cost of 100% point turboexpander efficiency in FIG. 9, as in FIG. 8, represents the dollar value (at 25 cents per 100 cubic feet of gas as liquid equivalent) of the imported nitrogen required to add to the plant as liquid to produce required refrigeration in order to sustain the plant operation with this oxygen producing cycle. Here, again, the low cost turboexpander of the present invention is denoted as line LCE with the diamond data points, whereas the state-of-the-art higher cost machine is denoted as curve HCE with the square data points. Curve CPC, with the snow flake data points, denotes the additional capitalized power cost required to operate the oxygen producing cycle over and above the power required to operate the plant at the reference point of 100% turboexpander efficiency, corresponding to plant operation with liquid nitrogen addition for refrigeration.

With continued reference to FIG. 9, curve S1, with the triangular data points, is the sum of the high turboexpander cost (curve HCE, square data points) and the additional capitalized power cost (curve CPC, snow flake data points). Curve S1 is representative of the total cost associated with the use of the state-of-the-art high performance turboexpander in the oxygen producing gas plants with a thermodynamic cycle as shown in FIG. 6. As can be seen, an optimum, lowest cost, operation corresponds to a turboexpander efficiency of 80% of 90% for this case. On the other hand curve S2 with the circular data points is the sum of the lower cost turboexpander of the present invention (denoted as line LCE with the diamond data points) and the additional capitalized power cost (curve CPC, snow flake data points).

As can be seen, the use of the lower cost machine of the present invention, represented by curve S2, offers a significant cost advantage over the state-of-the-art higher cost turboexpander. At the optimum point of about 85% efficiency (corresponding to minimum capitalized cost with use of the higher cost machine), the overall cost savings for the present invention is about 70% over the higher cost expander. The savings, however, diminish with decreased turboexpander efficiency. The low cost machine of the present invention, although of moderate efficiency, is a better alternative if its turboexpander efficiency is above 65%. At this point its use offers no advantage over the use of the higher cost machine of superior efficiency of 85%, that is, when the latter is applied at its optimum, lowest cost point of operation.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A turboexpander capable of producing refrigeration, comprising:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, the maximum distance between said trailing edges of said guide vanes and said outer periphery of said turbine wheel being in the range of approximately 1% to 4% of the turbine wheel radius.

2. The turboexpander as set forth in claim 1, wherein the distance between said leading edge and said trailing edge of said guide vanes is a chord and wherein said chord is in the range of approximately 5% to 15% of the turbine wheel diameter.

3. The turboexpander as set forth in claim 2, wherein each of said guide vanes is substantially uncontoured between said leading edge and said trailing edge and has a substantially greater thickness at said leading edge than at said trailing edge.

4. The turboexpander as set forth in claim 3, wherein the thickness of each of said guide vanes at said leading edge is in the range of approximately 0.05 inch to 0.15 inch; and wherein the thickness of each of said guide vanes at said trailing edge is in the range of approximately 0.01 inch to 0.10 inch.

5. The turboexpander as set forth in claim 1, including:

bearing means on said central housing for rotatably supporting said shaft;

means for delivering lubricant into and away from said bearing means; and thermal shield means for thermally isolating said turbine housing and the process fluid within said turbine housing from said central housing and the lubricant within said central housing.

6. The turboexpander as set forth in claim 5, including:

labyrinth seal means along the length of said shaft between said bearing means and said turbine housing to prevent migration of the lubricant along said shaft into said turbine housing and to prevent migration of the process fluid out of said turbine housing along said shaft and into said central housing.

7. The turboexpander as set forth in claim 6, including:

means for providing sealing gas to said labyrinth seal means and means for withdrawing sealing gas from said labyrinth seal means as an additional expedient to prevent migration of the lubricant along said shaft into said turbine housing and to prevent migration of the process fluid out of said turbine housing along said shaft and into said central housing.

8. The turboexpander as set forth in claim 1, including:

a compressor housing on said second end of said center housing, said second end of said shaft extending into said compressor housing; and a compressor wheel mounted on said second end of said shaft and within said compressor housing for rotation with said shaft.

9. The turboexpander as set forth in claim 1, including:

a loading device housing attached to said second end of said center housing, said second end of said shaft extending into said loading device housing.

10. A turboexpander capable of producing refrigeration, comprising:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, the distance between said leading edge and said trailing edge being a chord, said chord being in the range of approximately 5% to 15% of the turbine wheel diameter.

11. A system comprising:

(a) a main heat exchanger; and (b) a turboexpander in fluid communication with said main heat exchanger, wherein said turboexpander includes:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, maximum distance between said trailing edges of said guide vanes and said outer periphery of said turbine wheel being in the range of approximately 1% to 4% of the turbine wheel radius.

12. The system as set forth in claim 11, wherein the distance between said leading edge and said trailing edge is a chord and wherein said chord is in the range of approximately 5% to 15% of the turbine wheel diameter.

13. The system as set forth in claim 11, including:

a rectification column system;

means for passing fluid from said turboexpander to said rectification column system; and means for recovering product from said rectification column system.

14. The system as set forth in claim 13, including:

means for passing waste fluid from said rectification column system to said main heat exchanger; and means for withdrawing waste fluid from said main heat exchanger.

15. The system at set forth in claim 11, including:

a rectification column system;

means for passing fluid from said main heat exchanger to said rectification column system;

means for recovering product from said rectification column system;

means for passing waste fluid from said rectification column system to said main heat exchanger or said turboexpander; and means for passing fluid or waste fluid from said turboexpander to said main heat exchanger.

16. The system as set forth in claim 11, including:

a rectification column system located between said main heat exchanger and said turboexpander to receive feed from said main heat exchanger and to send waste fluid to said turboexpander;

means for recovering product from said rectification column system; and means for passing waste fluid from said turboexpander to said main heat exchanger or said rectification column.

17. A method for producing product by the cryogenic rectification of feed air comprising:

(a) cooling feed air and passing the cooled feed air into a rectification column system;

(b) separating the feed air by cryogenic rectification in the rectification column system into product fluid and into waste fluid;

(c) withdrawing waste fluid from the rectification column system and passing the withdrawn waste fluid to a turboexpander;

(d) operating said turboexapander at 40% to 85% efficiency to expand said waste fluid to generate refrigeration;

(e) passing the expanded waste fluid in indirect heat exchange with feed air to carry out the cooling of step (a); and (f) recovering product from the rectification column system;

wherein the turboexchanger comprises:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, the maximum distance between said trailing edges of said guide vanes and said outer periphery of said turbine wheel being in the range of approximately 1% to 4% of the turbine wheel radius.

18. A method for producing product by the cryogenic rectification of feed air comprising:

(a) cooling feed air and passing the cooled feed air through a turboexpander;

(b) operating said turboexpander at 40% to 85% efficiency to expand the cooled feed air to generate refrigeration;

(c) passing the feed air into a rectification column system;

(d) separating the feed air by cryogenic rectification in the rectification column system into product fluid and into waste fluid;

(e) withdrawing waste fluid from the rectification column system and passing the waste fluid in indirect heat exchange with feed air to carry out the cooling of step (a); and (f) recovering product from the rectification column system;

wherein the turboexchanger comprises:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, the maximum distance between said trailing edges of said guide vanes and said outer periphery of said turbine wheel being in the range of approximately 1% to 4% of the turbine wheel radius.

19. A method for producing product by the cryogenic rectification of feed air comprising:

(a) cooling feed air in a main heat exchanger and passing the cooled feed air into either a rectification column system or into a turboexpander operating at 65% to 85% efficiency;

(b) passing the feed air from either the rectification column system and/or the turboexpander opeating at 65% to 85% efficiency to the main heat exchanger;

(c) withdrawing waste fluid from the main heat exchanger; and (d) recovering product from the rectification column system;

wherein the turboexchanger comprises:

a center housing extending between first and second ends;

a turbine housing attached to said first end of said center housing;

a shaft having a longitudinal axis mounted on said center housing for rotation about said longitudinal axis, said shaft having a first end extending into said turbine housing and a second end supporting a load;

a turbine wheel having an outer periphery mounted on said first end of said shaft and within said turbine housing for rotation with said shaft, said turbine wheel having a plurality of circumferentially spaced turbine blades thereon, each of said turbine blades extending between locations proximate said outer periphery of said turbine wheel and locations proximate said longitudinal axis;

said turbine housing defining inlet means for receiving process fluid at a region distant from said longitudinal axis and for discharging the process fluid toward said turbine blades; and annular nozzle means intermediate said inlet means and said turbine wheel and encompassing said turbine wheel for directing the process fluid from said inlet means toward and through said turbine blades, said nozzle means including a plurality of guide vanes, each of said guide vanes extending between a leading edge more distant from said turbine wheel and a trailing edge less distant from said turbine wheel, the maximum distance between said trailing edges of said guide vanes and said outer periphery of said turbine wheel being in the range of approximately 1% to 4% of the turbine wheel radius.

20. The method as set forth in claim 17 wherein the distance between said leading edge and said trailing edge of said guide vanes is a chord and wherein said chord is in the range of approximately 5% to 15% of the turbine wheel diameter.

21. The method as set forth in claim 18 wherein the distance between said leading edge and said trailing edge of said guide vanes is a chord and wherein said chord is in the range of approximately 5% to 15% of the turbine wheel diameter.

22. The method as set forth in claim 19 wherein the distance between said leading edge and said trailing edge of said guide vanes is a chord and wherein said chord is in the range of approximately 5% to 15% of the turbine wheel diameter.

23. The method as set forth in claim 17 wherein said product is nitrogen.

24. The method as set forth in claim 18 wherein said product is nitrogen.

25. The method as set forth in claim 19 wherein said product is one of: (1) oxygen; (2) oxygen and nitrogen; and (3) oxygen, nitrogen and argon.

* * * * *